United States Patent [19]

Wood, III et al.

[11] Patent Number: 4,600,052

[45] Date of Patent: Jul. 15, 1986

[54] COMPACT HEAT EXCHANGER

[75] Inventors: Charles D. Wood, III, San Antonio; Harvey S. Benson, Mico, both of Tex.

[73] Assignee: Southwest Research Institute, San Antonio, Tex.

[21] Appl. No.: 585,500

[22] Filed: Mar. 2, 1984

[51] Int. Cl.[4] ..... F28F 7/00

[52] U.S. Cl. ..... 165/165; 165/178; 165/180; 165/907

[58] Field of Search ..... 165/DIG. 10, 165, 178, 165/180, 109 R, 109 T; 138/38

[56] References Cited

U.S. PATENT DOCUMENTS 1,313,624 8/1919 Evans et al. ..... 138/38
3,732,919 5/1973 Wilson ..... 165/DIG. 10

FOREIGN PATENT DOCUMENTS 587557 4/1925 France ..... 165/165

*Primary Examiner*—Sheldon J. Richter
*Attorney, Agent, or Firm*—Gunn, Lee & Jackson

[57] ABSTRACT

A compact heat exchanger and method for making the same using the interior of randomly arranged interconnecting hollow spheres as a conduit for a first fluid and the exterior of same as a conduit for a second fluid of different temperature. The apparatus is constructed by fusing the points of contact between the objects of a packed cluster of objects, forming an impermeable layer on the fused objects and removing the fused objects to leave hollow shells interconnected at their points of contact. The interconnecting interiors of the hollow shells form an inner space to which fluid entry and exit ports may be provided to entry and exit manifolds. An outer interstitial space is realized by channeling the second fluid through the porosity in the cluster of shells comprised of the spaces outside the interconnected hollow shells.

9 Claims, 7 Drawing Figures

COMPACT HEAT EXCHANGER

BACKGROUND OF THE INVENTION

The function of heat exchangers is to move as much heat as rapidly as possible from a first fluid to a second fluid of different temperature. This involves maximizing the temperature difference at the boundary between the cooled and cooling fluids, maximizing the heat exchange surface area and minimizing the effect of the boundary between the cooled and cooling fluids. Some conventional heat exchangers maximize the temperature difference by using pipes to juxtapose the cooled and cooling fluids in cross-flow or counterflow arrangements and maximize the surface area by increasing the number and decreasing the spacing between pipes and by projecting fins into the fluids. To minimize interference with heat transfer across the cooled-cooling fluid boundary, relatively expensive metals of high thermal conductivity are often used.

A difficulty with using straight pipe to conduct cooled or cooling fluids, however, is that the layer of fluid adjacent the surface of the pipe is stagnant and resists heat flow more than a moving fluid because the stagnant layer only slowly mixes with the moving inner layer.

One method to circumvent this problem is to place fins on the pipes to increase the heat exchanger surface area. However, since a temperature gradient always exists along the fin itself, its effectiveness in transferring heat is limited in proportion to its length and cross section; furthermore, it should be fused to the pipe boundary to be effective. These restrictions greatly increase the cost of construction and maintenance of good heat exchangers.

Many conventional heat exchangers reduce these costs by increasing the number and decreasing the spacing between heat exchange pipes, thereby increasing the overall size of the heat exchange unit.

The current design choice for heat exchangers is, therefore, between a small expensive heat exchanger which may be difficult to maintain, or a larger less efficient heat exchanger. This choice is impractical for many heat exchanger needs.

A commercial need exists, and has long existed, for a compact and inexpensive heat exchanger as described below.

MATERIAL INFORMATION DISCLOSURE STATEMENT

Several heat exchangers are known in the prior art. The following representative patents are related to the subject matter hereof but do not teach or suggest the present invention.

U.S. Pat. No. 3,732,919, Joseph R. Wilson, Heat Exchanger, discloses a heat exchanger having numerous solid particles such as coarse sand, gravel or spherical pellets of concrete packed within the coolant pipe. The claimed effect of such packed particles is to give the moving coolant a greater heat exchange surface area across which heat is then communicated from particle to particle and finally to the inner layer of the pipe. The preferred embodiments of the Wilson patent comprise long flat sheets of metal separated only by the contiguous particles. The solid particles both support the sheet metal and transfer the heat to it.

U.S. Pat. No. 3,825,064, Kiyoshi Inoue, Heat Exchanger, uses solid compact metallic particles to form heat exchange surfaces. The surface formed by the compacting of such particles is extremely coarse and bumpy and is claimed to provide a larger effective surface area for heat exchange than a smooth surface. The porosity of the compacted particle surface is further claimed to permit fluid to flow about the particles and further increase surface area for heat exchange.

U.S. Pat. No. 4,246,057, Janowski, Heat Transfer Surface And Method For Producing Such Surface, concerns applying a porous reticulated organic foam layer on the outer side of the coolant pipe and then plating a thin metal coating upon the porous layer to increase the surface area available for heat exchange.

The surface roughness features shown in the above patents do not prevent the creation of a relatively stagnant boundary fluid layer and may, in fact, worsen this problem rather than helping it. Further, none of these patents create turbulence in both the first and second moving fluids nor teach or suggest the invented method and apparatus as described herein.

SUMMARY OF THE INVENTION

A compact heat exchanger and method for making the same using the interior of randomly arranged interconnecting hollow spheres as a conduit for a first fluid and the exterior of same as a conduit for a second fluid of different temperature. The apparatus is constructed by fusing the points of contact between the objects of a packed cluster of objects, forming an impermeable layer on the fused objects, and removing the fused objects to leave hollow shells interconnected at their points of contact. The innerconnecting interiors of the hollow shells form an inner space to which fluid entry and exit ports may be provided to entry and exit manifolds. An outer interstitial space is realized by channeling the second fluid through the porosity in the cluster of shells comprised of the spaces outside the interconnected hollow shells.

It is an object of the present invention to provide a compact heat exchanger which maximizes the heat exchange surface area, minimizes the problems of laminar fluid flow and boundary effects, resists corrosion, is usable at high pressures and temperatures, and which may be inexpensively produced and maintained.

Further advantages and objects will be disclosed below and will be apparent to those knowledgeable in the art.

DESCRIPTION OF THE PREFERRED EMBODIMENT

Figure 5:
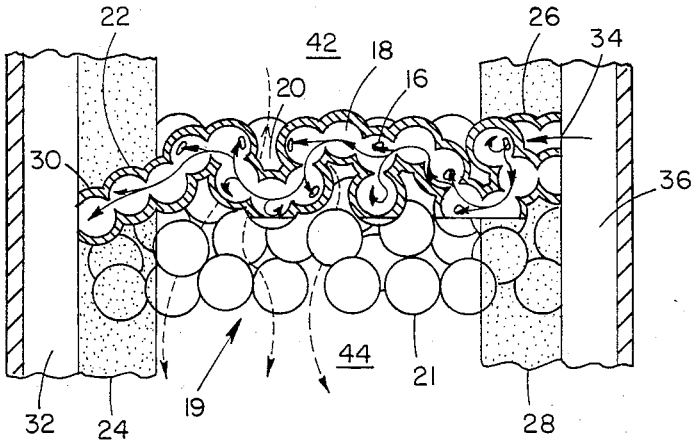
FIG. 5 is a section through FIG. 4 which shows the innerconnection of cavities formed within the ceramic coating of the invented heat exchanger along with openings to two ends of the cluster of spheres to permit a first fluid flow through the inner space within the spheres and a second fluid flow through the interstitial space about the spheres.
Figure 6:
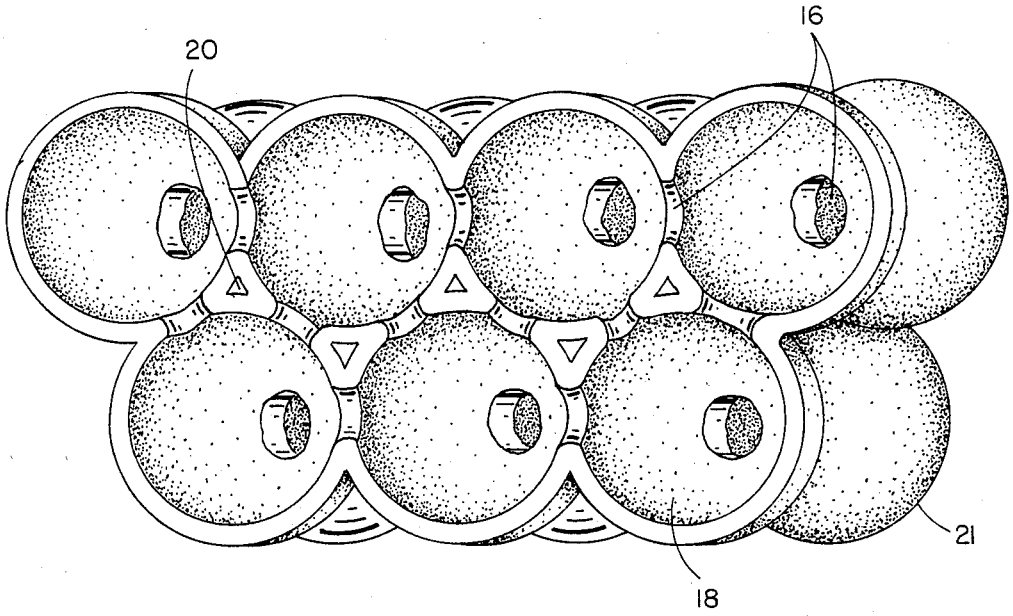
FIG. 6 shows a regular grouping of fourteen spherical shells such as would be produced by the coating of FIG. 5, the front layer of which are sectioned to disclose the passageways connecting the spherical cavities inside each shell to like spherical cavities of adjacent shells.

FIGS. 1 through 4 show the steps for creating the invention compact heat exchanger in an idealized form using eleven regularly arranged spheres. FIG. 6 shows the result of such an idealized process. FIG. 5 shows the invention in use. It is understood that while the use of an array of identical uniformly arranged spheres is within the scope and intent of the present invention, that randomly arrayed regular or irregular objects are an attractive alternate method of accomplishing the invention method and apparatus as are likewise other geometries and shapes.

Figure 1:
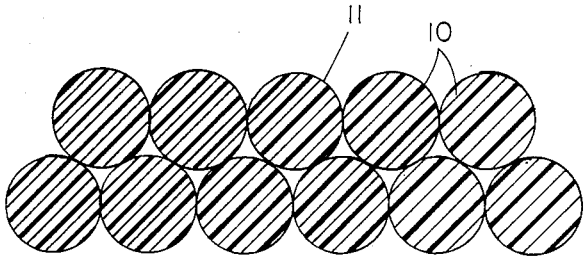
FIG. 1 is a schematic illustration of a cluster of eleven object spheres arranged in two rows.

The first step for making the invented compact heat exchanger is to position a cluster of adjacent form objects in the manner shown in FIG. 1. "Form objects" are objects useful for holding a coating and being subsequently removed from the coating and may sometimes be referred to herein as "objects". The objects 10 are preferably capable of being fused together at their contact points by convenient means including without limitation solvent wash, melting, mechanical pressure, etc., capable of retaining an exterior coating and finally capable of subsequent removal by melting, by means including without limitation sublimation, solvent or chemical reaction means. It has been found, for example, that paraffin wax balls approximately one third inch in diameter which have been surface treated with a 12% zirconium solution can hold coatings such as ceramics and can serve as the objects 10. Lead, ice, or any other removable material may also be used.

Figure 2:
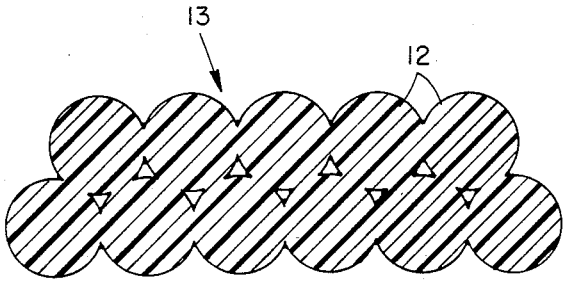
FIG. 2 shows the spheres of FIG. 1 fused at their points of contact.

The objects 10 are next fused together at their points of contact to create a cluster of fused objects 12 as shown in FIG. 2. "Fused" as used herein is defined as blending, melting, mechanical deformation, solvent washing, or chemical reaction, singularly or in combination, to accomplish a relationship sufficiently close to prevent a subsequent coating from penetrating the junctures or point of contacts between adjacent objects 10. For the described wax objects 10, such fusing may be accomplished by deforming the wax objects by heating them to a temperature just below the melting point of the particular wax being used for a short period of time. The temperature cycle employed must be determined for each wax formulation since too low a temperature or too short a heating period may not create sufficient fused points of adequate size between the objects 10 for optimum results. Conversely, too much heat or heating for too long a period detrimentally decreases the size of the passages remaining between the outer surfaces of the clustered shells in the final stage or may even cause the wax objects 10 to melt into an unuseable mass.

A coating material capable of self support following removal of the fused form objects 12 and capable of being coated upon the fused objects 12 in a desired thickness is deposited on the fused objects 12 of FIG. 2 to a desired thickness. A useful such coating 14 is a slurry or slip which becomes ceramic material upon firing at high temperature. Other coatings, including without limitation, plastics, metals, etc., may be usefully used in combination with or in the stead of ceramics. Pretreatment of the objects 10 or washings of the fused objects 12 may facilitate placing the coating upon the fused objects. Metallic coatings may be electroplated upon the fused objects 12 directly if they are electrically conductive or after they have been surface treated with an electrically conductive coating if not themselves electrically conductive.

Figure 7:
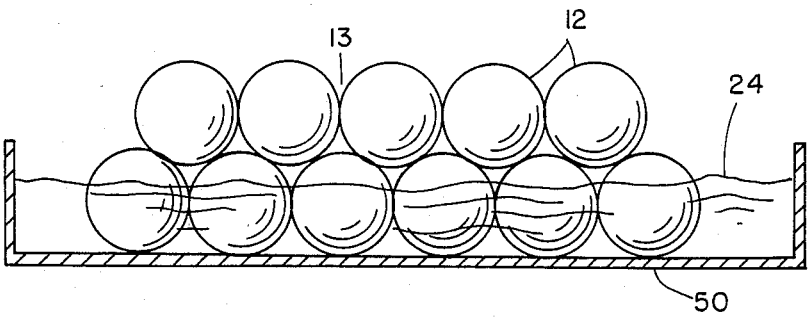
FIG. 7 shows a bonding layer being placed on one end of fused spheres.

FIG. 7 shows one method of forming exit and entry ports for later connection to inner space exit and entry manifolds. The cluster of fused form objects 13 is placed on a first side in a mold 50 with raised sides prior to washing with the ceramic layer and deformed against the side mold 50 to form a tight seal between the cluster of fused form objects 13 on the first side of the cluster and the side mold 50. A quantity of liquid ceramic or other first bonding layer material 24 sufficient to fill the space about the cluster of fused form objects 13 to a level in the mold 50 sufficient to provide a first bonding layer on the first side of the cluster of fused form objects 13 is then poured into the mold 50 and allowed to dry. The cluster of fused form objects 13 is then turned to a second side and the process repeated to form a second bonding layer.

The coating of the cluster and the placing of the first and second bonding layers on the first and second sides of the cluster can be accomplished in many different ways. Unfused form objects can be deformed against one or more molds and a bonding layer placed on it followed by the remainder of the cluster, fusing and coating. Fused form objects can be deformed against one or more molds and a bonding layer placed on it followed by the remainder of the cluster. A fused cluster of form objects can be deformed against one or more molds and the bonding layer placed on it. Bonding layers can be placed on a coated cluster and the bonding layers sectioned or penetrated to provide access to the form objects.

Figure 3:
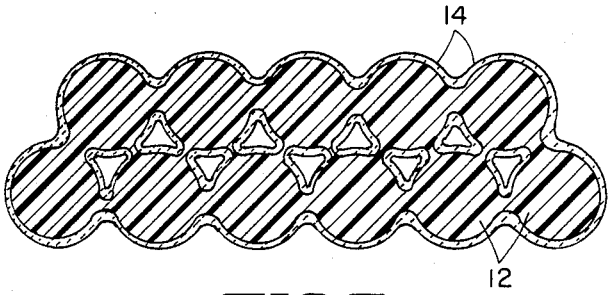
FIG. 3 shows the spheres of FIG. 2 with a thin coating of ceramic deposited upon them.

After the coating 14 has dried upon the fused objects 12 as shown in FIG. 3, the fused objects 12 are removed from the coating 14. This may be accomplished by any means which does not adversely affect the integrity of the coating 14. Although solvents or other methods may be used, heating is the preferable method of removing the example paraffin wax fused objects 12. The heat and time required vary inversely within reasonable limits. It may be helpful to rotate the heated coated cluster to completely drain the now fluid objects. After removal of sufficient amounts of wax or other fused objects 12 material to create a contiguous inner space from a first side of the coated cluster to a second side the residue may be removed by flowing hot fluids, solvents, or other materials or combinations of materials useful for removing the residue through the inner space. Flowing the removal fluid through the inner space in a reverse direction will help assure complete removal of the residue. To provide a means of testing for complete removal of residue either various tracer materials such as x-ray fluorescence, radioactive or radio opaque materials may be initially included in the form objects to facilitate testing said cluster of shells for residue.

Figure 4:
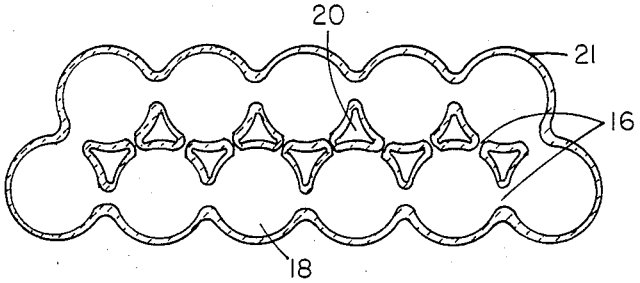
FIG. 4 shows the coating of FIG. 3 remaining after the fused spheres have been removed.

After the fused objects 12 have been removed, the coating 14 remains as is shown in FIG. 4. The coating 14 may have additional coatings placed on it or may be processed by firing, sintering, or other suitable procedures to produce finished shells 21 for use in the heat exchanger.

FIG. 6 shows a regular array of hollow spherical shells 21 with the front layer vertically sectioned midway to reveal inner passages 16 formed by application of the art taught herein. Said inner passages coincide with the location of the points of contact between the aforementioned fused objects 12. FIG. 6 shows that two sets of mutually exclusive passages thus exist, an inner space comprised of a set of inner passages 16 connecting the spherical cavities 18 and an interstitial space comprised of a set of outer passages 20 connecting the exterior spaces about the shells 21. The internal and external passages 16 and 20 are also apparent in FIG. 4.

FIG. 5 illustrates an embodiment of a portion of a completed invented compact heat exchanger fabricated over a random cluster 19 of regular spheres 21. A first side 22 of the cluster 19 is embedded in a first bonding layer 24. A second side 26 of the cluster 19 is embedded in a second bonding layer 28. The first side 22 is open through the first bonding layer 24 to open end cavities 30 of the cluster 19 to first manifold 32. The second side 26 of cluster 19 is opened through a second bonding layer 28 to open end cavities 34 to second manifold 36. The cavities 18 of cluster 19 interconnect by means of inner passages 16 to create inner space channels for a first fluid to flow from first manifold 32 into end cavities 30 through cavities 18 and inner passageways 16 and out through end cavities 34 into second manifold 36. The space comprised of the cavities 18 and inner passageway 16 is sometimes referred to herein as the "inner space". A second fluid may flow from conduit 42, formed between the first and second bonding layers 24 and 28 on a third side of the cluster 19 through the outer passages 20 of cluster 19 to conduit 44, formed between the first and second bonding layers 24 and 28 on a fourth side of the cluster 19. The space comprised of the outer passages 20 is sometimes referred to herein as the "interstitial space".

In this example embodiment, the bonding layers 24 and 28 are attached before coating the cluster as described above. Placement of the bonding layers 24 and 28 on the cluster to form the first fluid circuit through the inner space may also serve to form a second fluid circuit through the interstitial space including the space on the cluster's third side between the bonding layers 24 and 28, the cluster external passages 20, and the space between the cluster's fourth side between bonding layers 24 and 28. It is understood that the first, second, third and fourth sides need not be arranged as shown in FIG. 5, but rather may be any sides of the cluster.

The bonding layers 24 and 28 may be comprised of any suitable impermeable material and are preferably connected on either side of the cluster 19 means to the first and second fluid manifolds 32 and 36.

An unusually large surface area per unit volume is available for heat transfer when a first fluid passes through the inner space of cavities 18 and inner passages 16 of the cluster 19 while a second fluid at different temperature passes simultaneously through the interstitial space of outer passages 20 left between the shells 21 of the cluster 19.

A particular advantage of the invented apparatus is that the poor heat exchange properties characteristic of laminar fluid flow discussed above are avoided for both the first and second fluids. Great turbulence is produced within the first fluid as it flows through inner passages 16 and cavities 18 of the inner space, the first fluid gushing through an inner passage 16 to impinge directly against the opposite cavity wall before flowing onward through other inner passages 16. Likewise, the second fluid flowing through outer passages 20 of the interstitial space directly contacts the outer spherical surfaces of the shells 21 in cluster 19 to then be deflected toward another outer passage 20. The many currents of flow for the first fluid mix with each other due to the large number of randomly located and oriented inner passages 16 directing their flows angularly against the flows of other inner passages 16 and each cavity 18 and due to the number of inner passages 16 which serve as exit portals from each cavity 18. The same mixing likewise occurs for the second fluid. Turbulent, instead of laminar, flow of both fluids insures enhanced heat exchange action.

A further advantage of the instant invention is avoidance of expensive highly thermally conductive materials. The ceramic shells disclosed herein are a nearly ideal boundary between the working fluids since they can be made thin enough to reduce thermal conductivity as an efficiency factor to practical irrelevance notwithstanding the fact that their thermal conductivity is itself quite good. Ceramic materials are generally inexpensive. The expense of joining fins and pipes in order to enhance ordinary heat exchanger surface areas for heat transfer is eliminated in the present invention. Still further, unitary construction of the invented compact heat exchanger eliminates mechanical weaknesses and problems associated with joints in conventional heat exchangers. The invention derives superior structural strength and rigidity from the numerous points of contact supporting each spherical shell. This unique sphere configuration makes economically practical the application of low tensile strength materials, such as ceramics, to heat exchanger practical.

The use of a regular array of spheres is disclosed for the sake of convenience only. Random clusters of form objects other than spherical and irregular objects may be used. Any fluids may be used in the invented heat exchanger, including without limitation, gases, liquids and slurries.

The invented heat exchanger can be profitably designed to be corrosion resistant and be useful with corrosive fluids since its primary structure may be ceramic. This is quite advantageous as many of the metals used in conventional heat exchangers are subject to corrosion in direct proportion to their cost. The ability to use thin ceramic materials as the working fluid boundary derives from the novel structural geometry made practical by the invented apparatus and method and is economically produceable by the methods of the present invention. Corrosion is further reduced by using a single material throughout the heat transfer portion of the apparatus and by that material, a ceramic, being dielectric.

The invented heat exchanger in its ceramic embodiment may operate at higher temperatures without damage than many prior art metallic devices, because ceramic materials have superior strength at elevated temperatures.

The invented heat exchanger may operate at higher pressure gradients between working fluids than many prior art designs of similar wall thickness if the greater pressure is placed on the outside of the hollow spheres because the sphere is the ideal shape to resist external compressive forces.

As a consequence of the advantages enumerated above, virtually any combination of working fluids may be used. In contrast, most current heat exchangers are limited in application by possible corrosion, cracking or other degradation if certain fluids are employed.

It is apparent from the above descriptions that significant improvements in the compact heat exchanger art and methods of making the same are achieved by the instant invention. While the invention has been described in connection with the preferred embodiment, it is not intended to limit the invention to the particular form set forth, but, on the contrary, it is intended to cover such alternatives, modifications and equivalents as may be included within the spirit and scope of the invention as defined by the appended claims.

What is claimed is:

1. A compact heat exchanger apparatus comprising:

a cluster of hollow shells, each said shell having an outer surface and an inner surface, said shells being clustered to connect portions of their said outer surfaces with portions of said outer surfaces of adjacent said shells to form a substantially contiguous interstitial space between the unconnected portions of said outer surfaces, said inner surfaces forming cavities which are interconnected by inner passages through said connecting portions of said shells' outer surfaces to cavities in adjacent said shells, at least some of said cavities and inner passages comprising a contiguous inner space within said inner surfaces of said cluster, fluid communication between said interstitial space and said inner space being prevented by said shells;

a first side of said cluster bonded to a first bonding layer which seals said interstitial space on said first side of said cluster, said first side of said cluster being open to the exterior side of said first bonding layer to make said inner space accessible to a first manifold connected to said exterior side of said first bonding layer;

a second side of said cluster bonded to a second bonding layer which seals said interstitial space on said second side of said cluster, said second side of said cluster being open to the exterior side of said second bonding layer to make said inner space accessible to a second manifold connected to said exterior side of said second bonding layer;

said cluster being permeable to a first fluid flowing from said first manifold through said inner space to said second manifold and permeable to a second fluid flowing from a third side of said cluster through said interstitial space to a fourth side of said cluster without mixing said first fluid with said second fluid; and said apparatus being useable to exchange heat between a flowing said first fluid and a flowing said second fluid.

2. The apparatus of claim 1 wherein said inner space is shaped to cause substantial turbulence within said first fluid as it flows through said inner space and said interstitial space is shaped to cause substantial turbulence within said second fluid as it flows through said interstitial space.

3. The apparatus of claim 2 wherein said shells are comprised of fired ceramic materials and said apparatus is substantially corrosion resistant, is capable of operating at high temperatures and at high pressure gradients from said second fluid to said first fluid.

4. The apparatus of claim 2 wherein said shells are comprised of an electroformed metal and said apparatus is substantially corrosion resistant, is capable of operating at high temperatures and at high pressure gradients from said second fluid to said first fluid.

5. The apparatus of claim 2 wherein said shells, are irregularly shaped.

6. The apparatus of claim 2 wherein said shells are regularly shaped.

7. The apparatus of claim 5 or 6 wherein said shells are randomly arranged.

8. The apparatus of claim 5 or 6 wherein said shells are regularly arranged.

9. The apparatus of claim 2 wherein said shells are spherical.

* * * * *